US010269333B1

(12) United States Patent
Vater et al.

(10) Patent No.: US 10,269,333 B1
(45) Date of Patent: Apr. 23, 2019

(54) KIT FOR ENHANCING THE DURABILITY OF A DRUMSTICK BY PROTECTING AGAINST WEAR AND BREAKAGE IN THE RIMSHOT AREA OF THE DRUMSTICK

(71) Applicants: Alan J. Vater, Holbrook, MA (US); John A. Coviello, Holbrook, MA (US)

(72) Inventors: Alan J. Vater, Holbrook, MA (US); John A. Coviello, Holbrook, MA (US)

( * ) Notice: Subject to any disclaimer, the term of this patent is extended or adjusted under 35 U.S.C. 154(b) by 0 days.

(21) Appl. No.: 15/880,471

(22) Filed: Jan. 25, 2018

(51) Int. Cl.
*G10D 13/02* (2006.01)
*G10D 13/00* (2006.01)

(52) U.S. Cl.
CPC ..... *G10D 13/003* (2013.01)

(58) Field of Classification Search
None
See application file for complete search history.

(56) References Cited

U.S. PATENT DOCUMENTS 3,585,897 A * 6/1971 Stalcup ..... G10D 13/003 84/422.4

FOREIGN PATENT DOCUMENTS

DE 102006018399 A1 * 10/2007 ..... G10D 13/003

* cited by examiner

*Primary Examiner* — Robert W Horn
(74) *Attorney, Agent, or Firm* — Russ Weinzimmer & Associates, P.C.

(57) ABSTRACT

A drumstick enhancement kit that increases the durability of the rimshot area of a drumstick. The drumstick enhancement kit includes a durable surrounding pad to be attached along and around the rimshot portion of the drumstick, thereby forming a seam. A strip of seam protective tape is then applied over and along at least a portion of the seam. The drumstick enhancement kit enhances the durability of the drumstick by resisting rimshot damage caused by the drumstick striking the rim of a drum. The rimshot area of the drumstick is protected with a durable surrounding pad made of high strength material such as a para-aramid synthetic fiber, e.g., Kevlar® fiber from Dupont®. The drumstick enhancement kit prevents chipping, fraying, and splintering of the shaft of the drumstick. Due to the light weight of the parts of the drumstick enhancement kit, the balance and feel of a traditional drumstick are preserved.

20 Claims, 4 Drawing Sheets

KIT FOR ENHANCING THE DURABILITY OF A DRUMSTICK BY PROTECTING AGAINST WEAR AND BREAKAGE IN THE RIMSHOT AREA OF THE DRUMSTICK

FIELD OF THE INVENTION

This invention relates to drumsticks, and more particularly to kits for enabling a consumer to modify drumsticks.

BACKGROUND OF THE INVENTION

Traditional wooden drumsticks are often used to play "rimshots", a rimshot being performed by simultaneously striking a drum head with the tip of a drumstick, while also striking the rim of the drum with the side of the drumstick, resulting in a desirable accented drum sound. The rimshot portion of a drumstick is the portion of the drumstick that comes into contact with the rim during a rimshot, which is generally the middle region along the shaft of the drumstick. Repeated impact of the shaft with the rim of the drum causes damage to the rimshot portion, including chipping, fraying, and splintering of the wood of the shaft.

Donohoe, U.S. Pat. No. 5,341,718 teaches a polymer sleeve embedded in a channel milled into the shaft, the polymer sleeve having greater resistance to rimshot damage than the wood of the shaft. However, the method of fabrication involves wood milling steps that narrow the shaft, thereby weakening it, and changing the balance and "feel" of the drumstick. Then, injection molding is used to apply molten fiberglass-filled nylon polymer so as to form a structure that covers the rimshot area of the drumstick. The balance and feel of the drumstick is thereby further altered from the desirable "wooden feel" of a traditional wooden drumstick, also resulting in an unfavorable sound when the polymer sleeve strikes the rim when performing rimshots.

SUMMARY OF THE INVENTION

The drumstick enhancement kit of the invention was created to enable a consumer to enhance the durability of a drumstick by protecting against wear and breakage in the rimshot area of the drumstick. The rimshot area of the drumstick can be protected by attaching a durable surrounding pad provided in the kit, the durable surrounding pad including an impact-resistant material, such as a para-aramid synthetic fiber, an example of which is Kevlar®, made by Dupont®. Para-aramid synthetic fibers have a tensile strength that is approximately 6 times the strength of high strength steel, and have a specific strength that is approximately 80 times the specific strength of high strength steel. The durable surrounding pad prevents damage to the rimshot area of the drumstick, thereby avoiding chipping, fraying, and splintering of the wooden shaft of the drumstick, while preserving the balance and feel of a traditional wood drumstick. Because of the light weight of the durable surrounding pad, the playability of the drumstick is not significantly altered from that of a traditional drumstick.

A general aspect of the invention is a drumstick enhancement kit for increasing the durability of a rimshot portion of a drumstick. The drumstick has a butt portion, a shaft portion, a shoulder portion, and a tip portion, the rimshot portion extending along some of the shaft portion. The drumstick enhancement kit includes: a durable surrounding pad attachable along and around the rimshot portion so as to form a seam, and a strip of seam protective tape configured to be applied over and along at least a portion of the seam.

In some embodiments, the durable surrounding pad is attachable to the rimshot portion by an adhesive.

In some embodiments, the durable surrounding pad includes an adhesive backing.

In some embodiments, the durable surrounding pad includes at least one of: poly-paraphenylene terephthalamide fiber, diaminodiphenylether-para-phenylenediamine-terephthaloyldichloride fiber, and carbon fiber.

In some embodiments, the durable surrounding pad is sized so as to form an abutting seam when the durable surrounding pad is attached along and around the rimshot portion.

In some embodiments, the durable surrounding pad is configured to be attached around the shaft portion so as to form an abutting seam where a first longitudinal edge of the durable surrounding pad abuts a second longitudinal edge of the durable surrounding pad.

In some embodiments, the durable surrounding pad is sized so as to form an overlapping seam when the durable surrounding pad is attached along and around the rimshot portion.

In some embodiments, the durable surrounding pad is configured to be attached around the shaft portion so as to form an overlapping seam where a first longitudinal edge of the durable surrounding pad extends over a second longitudinal edge of the durable surrounding pad.

In some embodiments, the strip of seam protective tape is at least 1.5 inches in length, and at least 0.2 inches in width.

In some embodiments, the durable surrounding pad is at least 2.5 inches in longitudinal length.

In some embodiments, the durable surrounding pad is no more than 4.0 inches in longitudinal length.

In some embodiments, the durable surrounding pad is substantially 3 inches in longitudinal length.

In some embodiments, the durable surrounding pad is configured to be used with a standard 5 Series drumstick, the durable surrounding pad being at least 2.5 inches in longitudinal length.

In some embodiments, the durable surrounding pad is sized so as to be used with at least one of: 2 Series drumsticks, 3 Series drumsticks, 5 Series drumsticks, 7 Series drumsticks, 8 Series drumsticks.

Another general aspect of the invention is a drumstick enhancement kit for increasing the durability of a rimshot portion of a drumstick. The drumstick has a butt portion, a shaft portion, a shoulder portion, and a tip portion, the rimshot portion extending along some of the shaft portion. This drumstick enhancement kit includes: a durable surrounding pad attachable along and around the rimshot portion so as to form a seam, the durable surrounding pad including at least one layer of poly-paraphenylene terephthalamide fabric, the durable surrounding pad including an adhesive backing, and a strip of seam protective tape configured to be applied over and along at least a portion of the seam.

In some embodiments, the strip of seam protective tape is clear.

In some embodiments, the strip of seam protective tape made from PET plastic film.

In some embodiments, the strip of seam protective tape is substantially 12 mm in width, and substantially 1 mil thick.

In some embodiments, the durable surrounding pad is sized so as to form an abutting seam when the durable surrounding pad is attached along and around the rimshot portion.

In some embodiments, the durable surrounding pad is sized so as to form an overlapping seam when the durable surrounding pad is attached along and around the rimshot portion.

BRIEF DESCRIPTION OF THE DRAWINGS

Many additional features and advantages will become apparent to those skilled in the art upon reading the following description, when considered in conjunction with the accompanying drawings, wherein.

DETAILED DESCRIPTION

Figure 1:
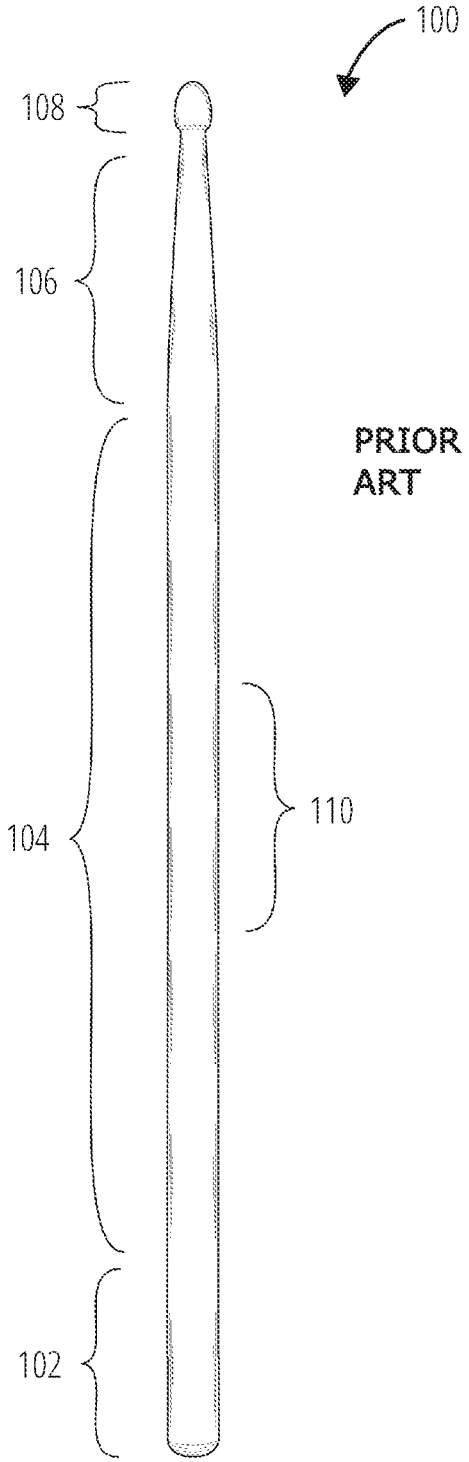
FIG. 1 is a side view showing the portions of a traditional drumstick, also showing the rimshot portion of the drumstick.

FIG. 1 shows a side view of a traditional drumstick 100 showing a butt portion 102, a shaft portion 104, a shoulder portion 106, and a tip portion 108.

The rimshot portion 110 is the portion of the drumstick that strikes the rim of a drum when playing a rimshot. The rimshot portion 110 is located generally within a middle portion of the shaft portion 104 of the traditional drumstick 100, the rimshot portion 110 being the area along the shaft portion 104 that most people tend to strike upon the rim when playing a rim shot.

The traditional drumstick 100 tip portion 108 is made of wood, and the wood tip can sometimes be covered with nylon to provide a nylon tip (not shown).

Figure 2A:
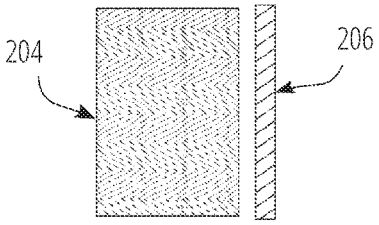
FIG. 2A is a top view of the drumstick enhancement kit.

FIG. 2A is a top view of a drumstick enhancement kit 200, which includes a durable surrounding pad 204 and a strip of seam protective tape 206.

In some embodiments, the strip of seam protective tape 206 is clear. In some embodiments, the strip of seam protective tape 206 is made from PET plastic film. In some embodiments, the strip of seam protective tape 206 is substantially 12 mm in width, and substantially 1 mil thick. In some embodiments, the strip of seam protective tape 206 is at least 1.5 inches in length, and at least 0.2 inches in width.

The durable surrounding pad 204 is between 2.5 inches and 4.0 inches in longitudinal length. Preferably, the durable surrounding pad 204 is substantially 3 inches in longitudinal length.

The durable surrounding pad 204 includes a layer of ballistic fiber, such as a layer of poly-paraphenylene terephthalamide fiber (sold as Kevlar® by Dupont®), or diaminodiphenylether-para-phenylenediamine-terephthaloyldichloride fiber (sold as Technora® by Teijin Aramid in the Netherlands), or carbon fiber.

The durable surrounding pad 204 also includes a layer of pressure sensitive adhesive (PSA). Adhesives which are based on natural or synthetic rubbers, and formulated with tackifying resins, oils, and anti-oxidants are preferred. A PSA based on rubber is the most cost effective PSA, and offers quick stick capability.

PSA is applied to the ballistic layer as a relatively thin flexible layer. The PSA layer will adhere with pressure to a variety of coated and uncoated wood, plastic, or metal surface of the shaft of a drumstick when the surface is clean and dry. The adhesive bonds to the surface of the shaft of the drumstick in proportion to the amount of pressure applied to the durable surrounding pad 204.

The PSA layer the durable surrounding pad 204 is protected by a silicone coated release liner, such as a layer of silicone coated paper. The silicone coated paper is removed from the durable surrounding pad 204 before applying the durable surrounding pad 204 around the rimshot portion of a drumstick.

Figure 2B:
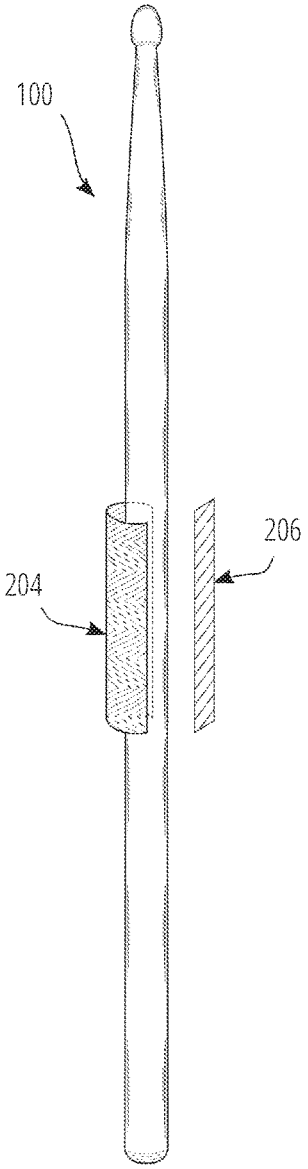
FIG. 2B is a perspective view of the parts of the drumstick enhancement kit of FIG. 2A, with the durable surrounding pad in a curved configuration prior to wrapping it around the rimshot portion of the traditional drumstick, and prior to applying the strip of seam protective tape.

FIG. 2B shows a perspective view of the durable surrounding pad 204 in a curved configuration prior to application to a traditional drumstick 100. The durable surrounding pad 204 is wrapped around the rimshot portion 110 of the traditional drumstick 100 (as shown in FIG. 1). Also shown in alignment with the durable surrounding pad 204 is a strip of seam protective tape 206 which can be applied along the seam of the durable surrounding pad 204 after the durable surrounding pad 204 is wrapped around the traditional drumstick 100.

Figure 2C:
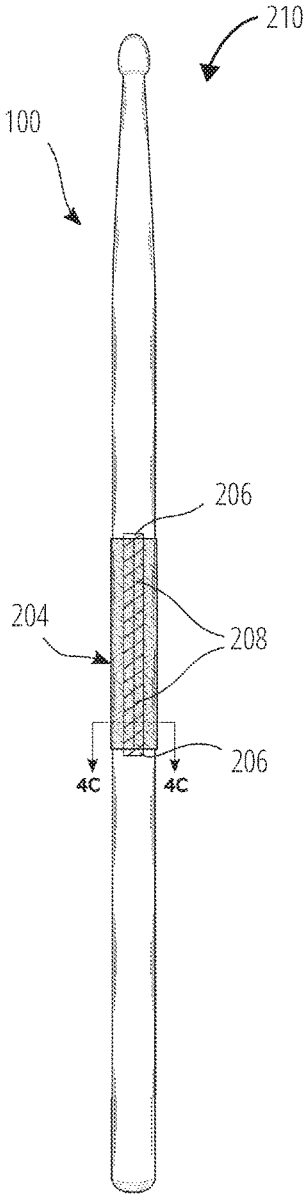
FIG. 2C is a side view of the drumstick enhancement kit after application to the traditional drumstick at the rimshot portion of the drumstick.

FIG. 2C shows a side view of a drumstick enhancement kit 200 after application of the drumstick enhancement kit 200 to the traditional drumstick 100 to form an enhanced drumstick 210. The durable surrounding pad 204 has been wrapped around and applied to the traditional drumstick 100, and a strip of seam protective tape 206 has been applied over and along an abutting or overlapping seam 208 of the durable surrounding pad 204 after the durable surrounding pad 204 was applied to the traditional drumstick 100. The durable surrounding pad 204 and the strip of seam protective tape 206 are applied at the rimshot portion 110 of the traditional drumstick 100 (both shown in FIG. 1).

Figure 3A:
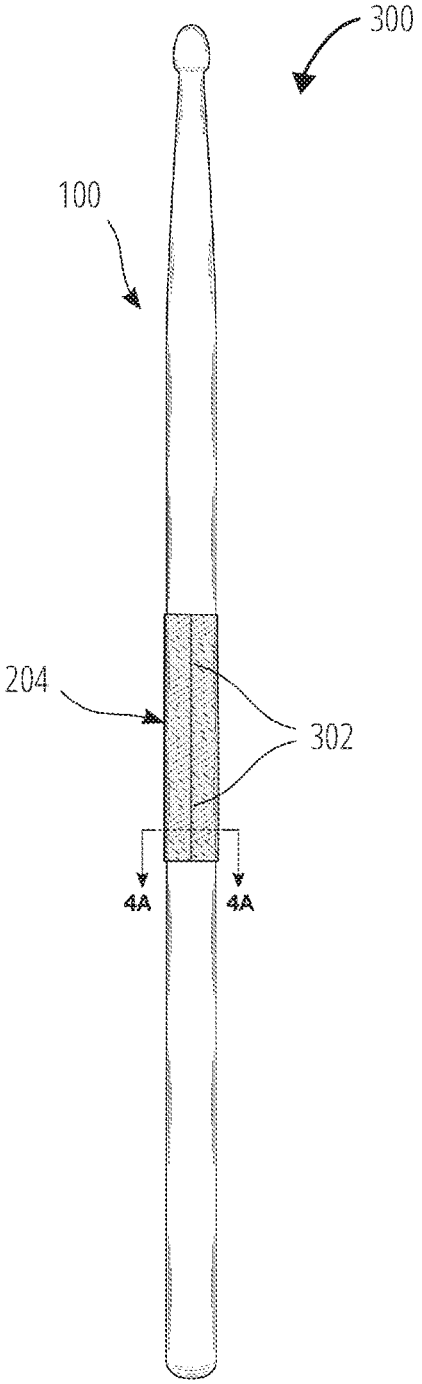
FIG. 3A is a side view of the enhanced drumstick with an abutting seam.

FIG. 3A shows a side view of an enhanced drumstick 300, after the application of a drumstick enhancement kit 200 including a durable surrounding pad 204 with an abutting seam 302. The durable surrounding pad 204 is applied at the rimshot portion 110 of the traditional drumstick 100 (both shown in FIG. 1).

Figure 3B:
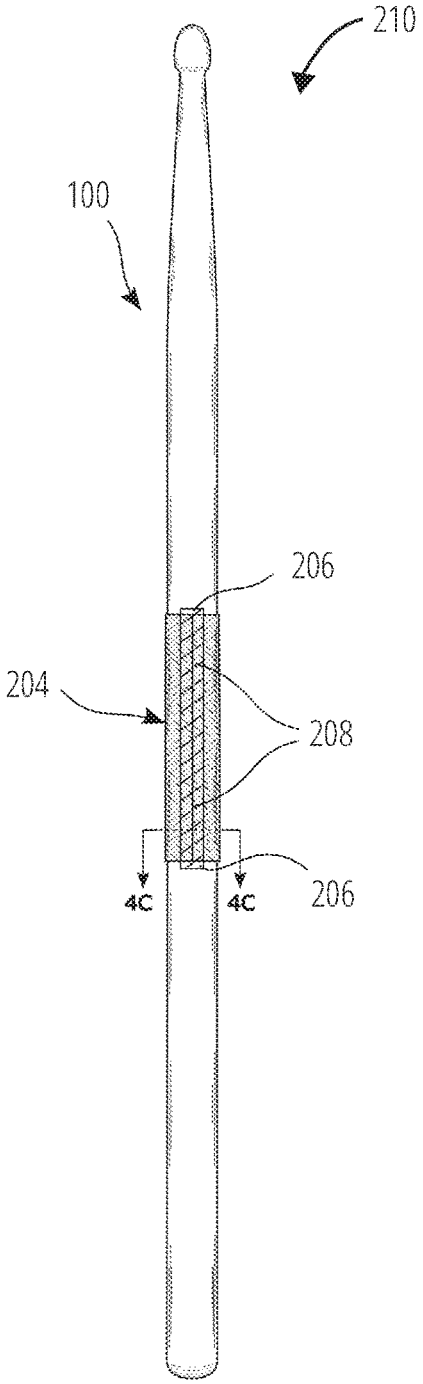
FIG. 3B is a side view of an alternate embodiment of the enhanced drumstick with either an abutting seam or an overlapping seam and with the strip of seam protective tape.

FIG. 3B shows a side view of an enhanced drumstick 210, including a durable surrounding pad 204 with an abutting or overlapping seam 208. The abutting or overlapping seam 208 is protected from damage caused by striking the rimshot portion of a drum by a strip of seam protective tape 206 applied longitudinally along the abutting or overlapping seam 208. The durable surrounding pad 204 and the strip of seam protective tape 206 are applied at the rimshot portion 110 of the traditional drumstick 100 (both shown in FIG. 1).

Figure 4A:
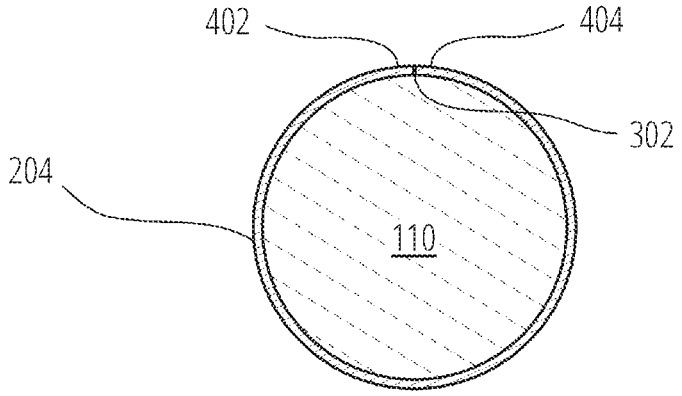
FIG. 4A is a cross-sectional view of the shaft portion of one embodiment the enhanced drumstick with a durable surrounding pad which has an abutting seam.

FIG. 4A shows a cross section of the rimshot portion 110 (shown in FIG. 1) of the enhanced drumstick 300 (shown in FIG. 3A), with a durable surrounding pad 204 and an abutting seam 302. The abutting seam 302 is formed when the surrounding pad 204 is wrapped and attached by its adhesive backing around the rimshot portion 110 so that the opposing edges 402 and 404 meet in abutting relationship.

Figure 4B:
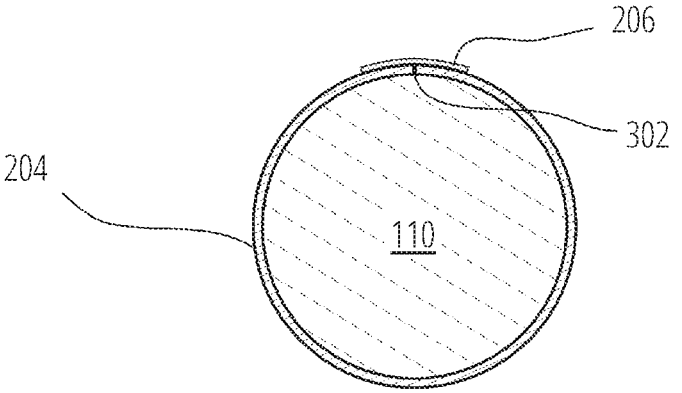
FIG. 4B is a cross-sectional view of the shaft portion of an embodiment of the enhanced drumstick with a durable surrounding pad which has an abutting seam and a strip of seam protective tape.

FIG. 4B shows a cross section of the rimshot portion 110 (shown in FIG. 1) of the enhanced drumstick 210 (shown in FIG. 2C), with a durable surrounding pad 204, an abutting seam 302, and a strip of seam protective tape 206.

Figure 4C:
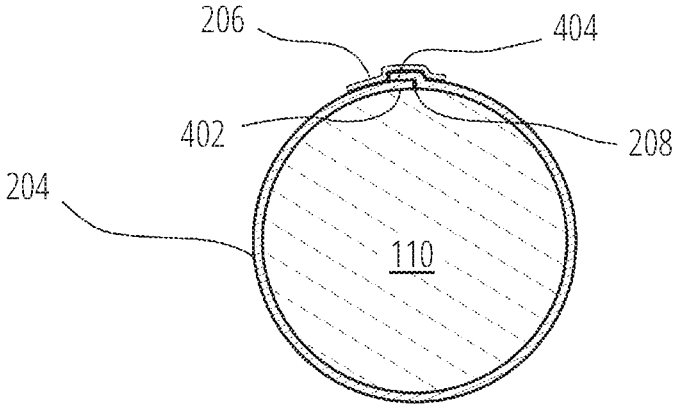
FIG. 4C is a cross-sectional view of the shaft portion of an embodiment of the enhanced drumstick with a durable surrounding pad which has an overlapping seam and a strip of seam protective tape.

FIG. 4C shows a cross section of the rimshot portion 110 (shown in FIG. 1) of the enhanced drumstick 210 (shown in FIG. 2C), with a durable surrounding pad 204, an overlapping seam 208, and a strip of seam protective tape 206. The overlapping seam 208 is formed when the surrounding pad 204 is wrapped and attached by its adhesive backing around the rimshot portion 110 so that the opposing edges 402 and 404 meet in overlapping relationship.

The durable surrounding pad 204 can be configured to be used with a standard 5 Series drumstick, the durable surrounding pad 204 being at least 2.5 inches in longitudinal length. The durable surrounding pad 204 and the strip of seam protective tape 206 can be sized to fit the rim shot portion 110 (shown in FIG. 1) of various sizes of traditional drumstick 100, including but not limited to the following sizes of drumstick: 2 Series drumsticks, 3 Series drumsticks, 7 Series drumsticks, 8 Series drumsticks, Power 5A drumsticks, Power 5B drumsticks, MV7 Marching Snare Sticks, and MV8 Marching Snare Sticks.

Other modifications and implementations will occur to those skilled in the art without departing from the spirit and the scope of the invention as claimed. Accordingly, the above description is not intended to limit the invention, except as indicated in the following claims.

What is claimed is:

1. A drumstick enhancement kit for increasing the durability of a rimshot portion of a drumstick, the drumstick having a butt portion, a shaft portion, a shoulder portion, and a tip portion, the rimshot portion extending along some of the shaft portion, the drumstick enhancement kit comprising:

a durable surrounding pad attachable along and around the rimshot portion so as to form a seam; and a strip of seam protective tape configured to be applied over and along at least a portion of the seam.

2. The drumstick enhancement kit of claim 1, wherein the durable surrounding pad is attachable to the rimshot portion by an adhesive.

3. The drumstick enhancement kit of claim 1, wherein the durable surrounding pad includes an adhesive backing.

4. The drumstick enhancement kit of claim 1, wherein the durable surrounding pad includes at least one of: polyparaphenylene terephthalamide fiber, diaminodiphenylether-para-phenylenediamine-terephthaloyldichloride fiber, and carbon fiber.

5. The drumstick enhancement kit of claim 1, wherein the durable surrounding pad is sized so as to form an abutting seam when the durable surrounding pad is attached along and around the rimshot portion.

6. The drumstick enhancement kit of claim 1, wherein the durable surrounding pad is configured to be attached around the shaft portion so as to form an abutting seam where a first longitudinal edge of the durable surrounding pad abuts a second longitudinal edge of the durable surrounding pad.

7. The drumstick enhancement kit of claim 1, wherein the durable surrounding pad is sized so as to form an overlapping seam when the durable surrounding pad is attached along and around the rimshot portion.

8. The drumstick enhancement kit of claim 1, wherein the durable surrounding pad is configured to be attached around the shaft portion so as to form an overlapping seam where a first longitudinal edge of the durable surrounding pad extends over a second longitudinal edge of the durable surrounding pad.

9. The drumstick enhancement kit of claim 1, wherein the strip of seam protective tape is at least 1.5 inches in length, and at least 0.2 inches in width.

10. The drumstick enhancement kit of claim 1, wherein the durable surrounding pad is at least 2.5 inches in longitudinal length.

11. The drumstick enhancement kit of claim 1, wherein the durable surrounding pad is no more than 4.0 inches in longitudinal length.

12. The drumstick enhancement kit of claim 1, wherein the durable surrounding pad is substantially 3 inches in longitudinal length.

13. The drumstick enhancement kit of claim 1, wherein the durable surrounding pad is configured to be used with a standard 5 Series drumstick, the durable surrounding pad being at least 2.5 inches in longitudinal length.

14. The drumstick enhancement kit of claim 1, wherein the durable surrounding pad is sized so as to be used with at least one of:

2 Series drumsticks, 3 Series drumsticks, 5 Series drumsticks, 7 Series drumsticks, 8 Series drumsticks.

15. A drumstick enhancement kit for increasing the durability of a rimshot portion of a drumstick, the drumstick having a butt portion, a shaft portion, a shoulder portion, and a tip portion, the rimshot portion extending along some of the shaft portion, the drumstick enhancement kit comprising:

a durable surrounding pad attachable along and around the rimshot portion so as to form a seam, the durable surrounding pad including at least one layer of polyparaphenylene terephthalamide fabric, the durable surrounding pad including an adhesive backing; and a strip of seam protective tape configured to be applied over and along at least a portion of the seam.

16. The drumstick enhancement kit of claim 15, wherein the strip of seam protective tape is clear.

17. The drumstick enhancement kit of claim 15, wherein the strip of seam protective tape is made from PET plastic film.

18. The drumstick enhancement kit of claim 15, wherein the strip of seam protective tape is substantially 12 mm in width, and substantially 1 mil thick.

19. The drumstick enhancement kit of claim 15, wherein the durable surrounding pad is sized so as to form an abutting seam when the durable surrounding pad is attached along and around the rimshot portion.

20. The drumstick enhancement kit of claim 15, wherein the durable surrounding pad is sized so as to form an overlapping seam when the durable surrounding pad is attached along and around the rimshot portion.

* * * * *